United States Patent [19]

Nilssen

[11] Patent Number: 4,581,562

[45] Date of Patent: Apr. 8, 1986

[54] EXTRA-HIGH-EFFICIENCY FLUORESCENT LAMP BALLAST

[76] Inventor: Ole K. Nilssen, Caesar Dr., R.R. 5, Barrington, Ill. 60010

[21] Appl. No.: 506,420

[22] Filed: Jun. 21, 1983

[51] Int. Cl.[4] ..... H05B 37/02; H05B 39/04; H05B 41/36

[52] U.S. Cl. ..... 315/219; 315/287; 315/DIG. 7; 363/56; 363/74

[58] Field of Search ..... 315/209 R, 244, 287, 315/219, DIG. 7; 363/74, 56

[56] References Cited

U.S. PATENT DOCUMENTS

| | | | |
|---|---|---|---|
| 4,286,194 | 8/1981 | Sherman | 315/209 R |
| 4,370,600 | 1/1983 | Zansky | 363/56 |
| 4,375,608 | 3/1983 | Kohler | 315/287 X |
| 4,378,514 | 3/1983 | Collins | 315/DIG. 7 X |
| 4,461,980 | 7/1984 | Nilssen | 363/56 |

*Primary Examiner*—Palmer C. DeMeo
*Assistant Examiner*—William L. Oen

[57] ABSTRACT

Subject invention relates to an inverter-type electronic fluorescent lamp ballast wherein a series-resonant LC circuit connected across the inverter's output is used for matching the inverter's operating characteristics to those of the fluorescent lamp. The fluorescent lamp, combined with a Varistor, is connected in parallel with the tank-capacitor of this LC circuit. Thus, the starting voltage provided for the lamp is limited by the voltage-clamping-effect of the Varistor; and before the fluorescent lamp starts, all the output current from the ballast flows through this Varistor. After the lamp has started, however, the ballast output current shifts away from the Varistor and over to the lamp—leaving only a negligible amount of current to flow through the Varistor on a continuous basis. The essential aspect of subject invention relates to using the current flowing through the Varistor—with the help of an isolating current transformer—for providing heating power to the lamp cathodes. That way, the starting of the fluorescent lamp is accomplished in a normal rapid-start or trigger-start fashion; but, after the lamp has started, the power provided to the cathodes diminishes to a negligible level. Consequently, without the use of overt switching means, etc., subject ballast gains the efficiency-advantage associated with removing the cathode heating power after the lamp has started.

15 Claims, 1 Drawing Figure

EXTRA-HIGH-EFFICIENCY FLUORESCENT LAMP BALLAST

BACKGROUND OF THE INVENTION

1. Field of Invention

The present invention relates to ballast for rapid-start fluorescent lamps, particularly of a type wherein external cathode heating power is provided during lamp starting, but is automatically removed after the lamp has started.

2. Description of Prior Art

It is known in the art that the liminous efficacy of an ordinary rapid-start fluorescent lamp is substantially improved if the externally-provided cathode heating power is removed after the lamp has started.

One approach to automatically removing externally-supplied cathode heating power from the fluorescent lamp after the lamp has started, is described in U.S. Pat. No. 4,375,608 issued to Kohler. However, the approach described in that patent is extremely complex and costly.

No simple and inexpensive fluorescent lamp ballast with built-in means for automatically removing externally supplied cathode heating power has been previously described in available literature; nor is such a ballast available for purchase.

SUMMARY OF THE INVENTION

1. Objects of the Invention

A first object of the present invention is that of providing a basis for designing cost-effective high-efficiency ballasts for fluorescent lamps.

A second object is that of providing a basis for designing cost-effectiv ballasts for rapid-start fluorescent lamps wherein the externally supplied cathod heating power is automatically removed after the lamps have started.

These as well as other objects, features and advantages of the present invention will become apparent from the following description and claims.

2. Brief Description

In a preferred embodiment, subject invention constitutes a series-resonance-loaded fluorescent lamp ballast comprising the following key component parts:

a source of DC voltage, which DC voltage is derived by retification of the AC voltage obtained by way of a pair of power-line-conductores connected with a regular 60 Hz power line;

an inverter connected with said source of DC voltage and operation to provide across an output a relatively high-frequency squarewave voltage;

a series LC circuit connected across said output, said LC circuit being substantially series-resonant at the fundamental frequncy of said squarewave voltage;

means for connecting a fluorescent lamp in parallel across the tank-capacitor of said LC circuit, said fluorescent lamp requiring for proper starting a voltage of magnitude above a certain pre-established threshold level; and a Varistor and the primary winding of a current transformer connected in series across said tank-capictor, said Varistor being operative to limit the magnitude of the voltage across said tank-capacitor to a level somewhat higher than said threshold level, said current transformer being operative, by way of two separte secondary windings, to provide cathode heating power to the lamp's two thermionic cathodes for as long as current is flowing through the Varistor;

whereby for as long as the Varisotor is operative to provide voltage-clamping (which is for as long as it takes for the fluorescent lamp to start), cathode heating power is externally provided to said lamp; whereas, after the lamp has started, the amount of current flowing through the Varistor is negligible, which implies that the externally supplied cathode heating power is then likewise negligible.

DESCRIPTION OF THE PREFERRED EMBODIMENT

1. Description of the Drawing

Figure 1:
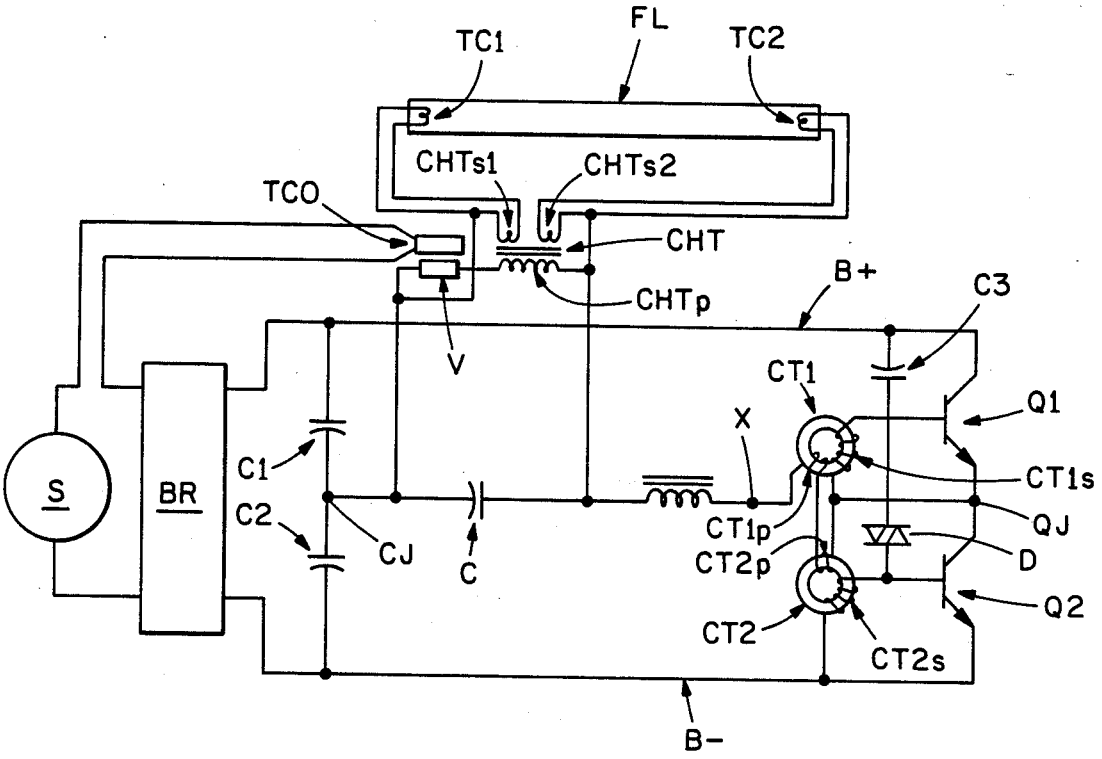
FIG. 1. schematically illustrates a circuit for an inverter-type ballast for a rapid-start fluorescent lamp in accordance with the preferred embodiment of the present invention.

In FIG. 1, by way of the switched terminals of a temperature-sensitive thermal-cut-out TCO, a source S of 120 volt/60 Hz voltage is applied to full-wave bridge rectifier BR, the undirectional voltage output of which is applied directly between a B+ bus, and a B− bus, with the positive voltage being connected to the B+ bus.

Between the B+ bus and the B− bus are connected a series-combination of two transistors Q1 and Q2 as well as a series-combination of two energy-storing capacitors C1 and C2.

The secondary winding CT1s of postive feedback current transformer CT1 is connected directly between the base and the emitter of transistor Q1; and the secondary winding CT2s of positive feedback current transformer CT2 is connected directly between the base and the emitter of transistor Q2.

The collector of transistor Q1 is connected directly with the B+ bus; the emitter of transistor Q2 is connected directly with the B− bus; and the emitter of transistor Q1 is connected directely with the collector of transistor Q2, thereby forming junction QJ.

One terminal of capacitor C1 is connected directly with the B+ bus, while the other termianl of capacitor C1 is connected with a junction CJ. One termianl of capacitor C2 is connected directly with the B− bus, while the other terminal of capacitor C2 is connected directly with junction CJ.

An inductor L and a capacitor C ar connected in series with one another and with the primary windings CT1p and CT2p of current transformers CT1 and CT2.

The series-connected primary windings CT1p and CT2p are connected directly between junction QJ and a point X. Inductor L is connected with one of its terminals to point X and with the other of its terminals to one of the terminals of capacitor C. The other termianl of capacitor C is connected directly with junction CJ.

A fluorescent lamp FL is connected in parallel-circuit across capacitor C, which lamp has two thermionic cathodes TC1 and TC2.

A Varistor V and primary winding CHTp of cathode-heating-transformer CHT are connected in series across capacitor C.

Cathode-heating-ttransformer CHT has two secondary windings CHTs1 and CHTs2 which are connected respectivly with cathodes TC1 and TC2.

A series-combination of a capacitor C3 and a Diac D is connected between the B+ bus and the base of transistor Q2.

A thermal cut-out TCO is electrically connected in series-circuit with the power line input to rectifier BR, and is thermally connected in close contact with Varistor V.

Representative values and designation of the various parts of the circuit of FIG. 1 are indicated as follows:

| | |
|---|---|
| Output of Source S: | 120 Volt/60 Hz; |
| Bridge rectifier BR: | a bridge of four 1N4004's; |
| Capacitors C1 & C2: | 100 uF/100 Volt Electrolytics; |
| Transistors Q1 & Q2: | Motorola MJE13002's; |
| Capacitor C: | 15 nF/1000 Volt (High-Q); |
| Fluorescent Lamp FL: | Sylvania Octron F032/31K; |
| Varistor V: | MARCON (Toshiba) TNR23G391KM; |
| Capacitor C3: | 22 nF/200 Volt; |
| Diac D: | 1N5760; |
| Thermal Cut-Out TCO: | Texas Instruments Klixon 7AM025A5; |
| Transformers CT1 & CT2: | Wound on Ferroxcube Toroids 213T050 of 3E2A Ferrite Material with three turns of #26 wire for the primary windings and ten turns of #30 wire for the secondary windings; |
| Inductor L: | 140 turns of three twisted strands of #30 wire on a 3019P-L00-3C8 Ferroxcube Ferrite Pot Core with a 120 mil air gap; |
| Transformer CHT: | Wound on an 1811P-LOO-3C8 Ferroxcube Ferrite Pot Core with 48 turns of #32 wire for the primary winding and 6 turns of #28 wire for each of the secondary windings. |

The frequency of inverter oscillation association associated with the component values identified above is approximately 33 kHz.

2. Description of Operation

In FIG. 1, the source S represents and ordinary electric utility power line, the voltage from which is applied by way of the switched terminals of a thermal-cut-out TCO to the bridge rectifier identified as BR. This bridege rectifier is of conventional construction and provides for the rectified line voltage to be appled to the inverter by way of the B+ bus and the B− bus.

The two energy-storing capacitors C1 and C2 are connected directly across the output of the bride rectifier BR and serve to filter the rectified line voltage, thereby providing for the voltage between the B+ bus and the B− to be substantially constant. Junction CJ between the two capacitors serves to provide a power supply center tap.

The inverter circuit of FIG. 1, whick represents a so-called half-bridge inverter, opertates in a manner that is analogous with circuts previously described in published literature, as for instance in U.S. Pat. No. 4,184,128 entitled High Efficiency Push-Pull Inverters.

Upon initial applicaion of power to the circuit, inverter oscillation is initiated by way of one or a few trigger pulses applied to the base of transistor Q2 by way of the combination of capacitor C3 and Diac D2.

The output of the half-bridge inverter is a substantially squarewave 33 kHz AC voltage provided between point X and junction CJ. Directly across this output is connected a resonant or near-resonant LC series circuit—with the fluorescent lamp connected in parallel with the tank-capacitor thereof.

The resonant or near-resonant action of the LC series circuit provide for appropriate lamp starting and operating voltages, as well as for proper lamp current limiting; which is to say that it provides for appropriate lamp ballasting.

When the inverter is operating, the voltage developed across the tank-capacitor is limited by the loading of the Varistor and/or the fluorescent lamp.

With the particular Varistor and lamp used in the preferred embodiment of FIG. 1, the voltage across the tank-capacitor is limited by the voltage-clamping characteristics of the Varistor until the fluorescent lamp starts, whereafter it is limited by the loading characteristics of the fluorescent lamp.

The main and general idea underlying the present invention is that of deriving the externally supplied cathode heating power from the current flowing through a voltage-clamping (or voltage-limiting) means that is connected across the lamp (the Varistor in this case), and which is operative to conduct current only when the voltage across it is higher than the normal lamp operating voltage.

Or, stated differently, the main and general idea is that of making the externally supplied cathode heating power dependent upon the presence across the lamp of a voltage that is substantially higher in magnitude than the normal lamp operating voltage—i.e., the lamp starting voltage.

Thus, by choosing (or selecting, or pre-establishing) the clamping voltage of the Varistor such that the magnitude of the voltage developed across it is substantially equal to that of the voltage required for proper lamp starting, current will flow through the Varisotr until the lamp starts. Thereafter, due to the fact (which results form the choice of clamping voltage) that the lamp operating volate is substantially lower in magnitude than the lamp starting voltage, current will no longer flow through the Varistor.

During the relatively brief period when current does flow through the Varisotor, cathode heating power is provided to the lamp's thermionic cathodes by way of current transformer CHT; which transforms the resulting Varistor clamping current into cathode heating currents of suitable magnitude. In this particular case, each of the two cathodes gets approximately three times the amount of current flowing through the Varistor.

In the arrangements of FIG. 1, the various relevant voltage and current magnitudes are approximately as follows: (i) lamp starting voltage: 350 Volt RMS for a period of not more than about one second; (ii) Varistor maximum RMS operating voltage and approximate effective clamping-voltage: 250 Volt RMS and 391 RMS, respectively; lamp operating voltage and current: 140 Volt RMS and 200 milli-Amp RMS, respectively.

In an LC series-resonant circuit fed from a voltage of constant magnitude, the current provides to a resistive load connected in parallel with the circuit tank-capacitor is approximately constant, regardless of the magnitude of the RMS voltage developed thereacross. Hence, in FIG. 1, as long as the parameters of the LC circuit have been arranged to provide the fluorescent lamp with its required 200 milli-Amp operating current at 140 Volt RMS, the current through the Varistor at 391 Volt RMS will also be about 200 milli-Amp. Thus, when the Varistor is clamping, and due to the current-transformation effect of thansformer CHT, the current provided to each cathode is about 600 milli-Amp; which is enough to cause the cathodes to become thermionic within a period of about one second or less.

Thus, the ballasting arrangement of FIG. 1 will start the fluorescent lamp in an entirely normal rapid-start fashiion. However, as soon as the lamp has started, the externally supplied cathode heating powr is removed; which implies a substantial reduction of the total power provided to the lamp for a given amount of light output.

It should be noted that, even though the externally supplied cathode heating power is removed during operation, the lamp's cathodes are still being heated. Namely: cathode heating is then beind provided by the main current flowing through the lamp in the forms of energetic particles stricking the cathodes.

It should also be noted that the ballast circuit of FIG. 1 is only properly operative when the fluorescent lamp is connected. If the circuit were to be activated with the lamp removed or inoperative, the Varistor would rapidly become over-heted and might self-destroy. However, the thermal cut-out TCO, which is thermally closely connected with the Varistor, provides for removal of powr from the entire ballast circuit in case of Varistor over-heating—or in case of over-heating for other reasons.

It should finally be noted tha tit is not necessary to use a Varistor for voltage-clamping: for instance, a Zener device can be used just as well.

And, an altogether different approach is that of acomplishing the clamping by way of applying the rectified output voltage from a secondary winding on inductor L across the main power supply (i.e., between the B− bus and the B+ bus); in which case the primary winding of the cathode heating transformer CHT would have to be onnected in series with this secondary winding on inductor L.

It is believed that the present invenion and its several attendant advantages and features will be understood from the prededing description. However, without departing from the spirit of the invention, changes may be made in its form and in the construciton and interrelationships of its component parts, the form herein presented merely representing the preferred embodiment.

I claim:

1. A ballasting means for a fluoroscent lamp, said lamp characteized by having a pair of thermionic cathodes which requires therebetween initially a lamp-starting voltage of relatively high magnitude for effecting lamp starting and subsequently a lamp-operating-voltage of relatively low magnitude for effecting continous lamp operation, said cathodes having each a pair of cathode input terminals, said ballasting means comprising:

a source of lamp-supply-voltage having an internal impedance, the magnitude of said lamp-supply-voltage being larger than that of said lamp-starting-voltage, said internal impedance being operative to limit the magnitude of the current available from said source to that required for proper operation of said lamp;

voltage-clamping-means connected in circuit between said pair of cathodes and operative to limit the magnitude of the voltage therebetween to that of said lamp-starting-voltage; and cathode-heating-means connected in circuit with said voltage-clamping-means and operative by way of said cathode input terminals to provide electric heating power to said cathodes in response to current flowing through said voltage-clamping-means.

2. The ballasting means of claim 1 wherein said voltage-clamping-means comprises a power-dissipative means.

3. The ballasting means of claim 2 wherein said voltage-clamping-means comprises a Varistor.

4. The ballasting means of claim 2 wherein a thermal cut-out-means is thermally coupled with said power dissipative-means and electrically coupled with said source of lamp-supply-voltage, and operative to remove said lamp-supply-voltage whenever the temperature of said power-dissipative-means exceeds a pre-established threshold.

5. The ballasting means of claim 1 wherein said cathode-heating-means comprises a transformer-means.

6. The ballasting means of claim 5 wherein said transformer-means has a primary winding coupled in circuit with said voltage-clamping means and secondary windings coupled in circuit with said cathode input terminals.

7. A ballast for a fluorescent lamp, said lamp having two thermionic cathodes, each with a pair of input terminals, said ballast comprising:

a source of lamp-supply-voltage having an internal impedance, the magnitude of said lamp-supply-voltage being larger than that of the voltage required to initiate lamp-operation, said internal impedance being operative to limit the amount of current provided from said source to that appropriate for proper lamp-operation;

voltage-clamping-means connected in circuit between said cathodes and operative to limit the voltage therebetween to a magnitude appropriate for effective lamp-starting; and cathode-heating-means connected in circuit with said voltage-clamping-means and operative by way of said cathode input terminals to provide electrical heating power to said cathodes for as long as said voltage-clamping-means is actively operative in limiting the voltage existing between said cathodes.

8. A loading and protective arrangements for an inverter-type power supply, said power supply being operable to convert a DC input voltage into an AC output voltage provided across a pair of output termianls, said arrangement comprising:

a series-combination of an inductor and a capacitor connected across said output terminals, said series-combination being substantially resonant at the fundamental frequency of said AC voltage;

load-coupling-means operative to couple a load in parallel-circuit with either the inductor or the capacitor of said series-combination;

power-dissipative-means coupled in parallel circuit with either the inductor or the capacitor of said series-combination, said power-dissipative-means being operative to limit the magnitude of moltage develope thereacross; and thermally-responsive cut-out-means thermally coupled with said power-dissipative-means and electrically coupled with said power supply, said cut-out-means being responsive to the temperature of said power-dissipative-means and operative to remove said AC voltage from said series-combination whenever said temperature exceeds a pre-determined level.

9. The loading and protection arrangement of claim 8 wherein said load comprises a fluorescent lamp having a pair of thermionic cathodes, and where part of the power absorbed by said power-dissipative-means is used for providing heating of said thermionic cathodes.

10. A ballasting arrangement for a fluorescent lamp, said lamp having two thermionic cathodes and a requiring therebetween for proper lamp operaiton an initial lamp-starting-voltage of relatively high magnitude and asubsequent lamp-operating-voltage of relatively low magnitude, said cathodes having each a pair of cathode input terminals, said arrangement comprising:

a source of lamp-operating-current, the magnitude of said lamp-operating-current being substantially equal to that of the current required for proper operation of said lamp;

connect means operable to connect said lamp circuit with said source of lam-operating-current;

voltage-clamping means connected in parallel-circuit with said connect means and operative to limit the magnitude of the voltage developed thereacross to that required for proper lamp starting; and cathode-heating-means connected incircuit with said voltage-clamping means and operative by way of said cathode input terminals to provide electrical heating power to said cathodes in response to current flowing through said voltage-clamping-means.

11. The ballasting arrangement of claim 10 wherein the current flowing through said voltage-clamping-means is of negligible magnitude after said lamp has started.

12. The ballasting arrangement of claim 10 wherein said source of lamp-operating-current comprises an inverter means.

13. The ballasting arrangement of claim 10 wherein said lamp-operating-current is an alternating current, and wherein said source comprises a series-combination of an inductor and a capacitor, said series-combination being series-resonant at the fundamental frequency of said alternating current.

14. The ballasting arrangement of claim 10 wherein said voltage-limiting-means comprises a power-dissipative means as well as a thermally-responsive cut-out-means, said cut-out-means being thermally coupled with said power-dissipative-means and electrically coupled with said source, and operative to remove said lamp-operating-current whenever the temperature of said power-dissipative-means exceeds a pre-determined level.

15. The ballasting arrangment of claim 14 wherein said voltage-limiting-means comprises a Varistor.

* * * * *